United States Patent [19]

Yindra

[11] Patent Number: 4,552,403

[45] Date of Patent: Nov. 12, 1985

[54] POWER-OPERATED MEDICAL EXAMINATION TABLE

[75] Inventor: Leonard J. Yindra, Manitowoc, Wis.

[73] Assignee: Hamilton Industries, Two Rivers, Wis.

[21] Appl. No.: 537,340

[22] Filed: Sep. 29, 1983

[51] Int. Cl.[4] ..... A47C 3/24

[52] U.S. Cl. ..... 297/330; 187/8.47; 192/143; 248/422; 248/550

[58] Field of Search ..... 297/330, 339, 345, 347; 248/405, 422, 550, 656; 187/24, 25, 8.47; 192/141, 142 R, 143; 108/147

[56] References Cited

U.S. PATENT DOCUMENTS

| | | | |
|---|---|---|---|
| 1,727,436 | 9/1929 | Kreutzkamp | 187/24 |
| 3,172,699 | 3/1965 | Naughton | 297/330 X |
| 3,295,621 | 1/1967 | Deeley, Jr. et al. | 297/345 X |
| 3,870,271 | 3/1975 | Bowman | 248/406 |
| 4,133,437 | 1/1979 | Cates | 187/24 X |

FOREIGN PATENT DOCUMENTS

| | | | |
|---|---|---|---|
| 2649868 | 5/1978 | Fed. Rep. of Germany | 108/147 |

*Primary Examiner*—William E. Lyddane
*Assistant Examiner*—Peter R. Brown
*Attorney, Agent, or Firm*—Tilton, Fallon, Lungmus

[57] ABSTRACT

A power-operated medical examination table having safety mechanisms for preventing injury or damage should someone or something become entrapped beneath the top of the table as it descends. The table includes a pedestal base having an extendable and retractable column. The top normally rests upon a load-bearing member which may be selectively raised or lowered under power to extend or retract the column. Should the top engage an obstruction during a lowering operation so that a separation occurs between the load-bearing member and the top, a sensor detects such separation and immediately interrupts power to prevent continued retraction of said load-bearing member. The table also includes at least one power-operated outer top section that is hinged to the central top section and is supported by a second load-bearing member and power drive arranged to constitute a secondary safety mechanism.

7 Claims, 12 Drawing Figures

POWER-OPERATED MEDICAL EXAMINATION TABLE

BACKGROUND AND SUMMARY

Multiple-position power-operated examination tables and chairs are known in the art as disclosed, for example, in U.S Pat. Nos. 4,168,099, 2,042,399, 3,754,749, 3,041,120, 3,281,141, 3,578,379, 3,241,828 and 3,206,188. Such supporting structures may be properly referred to as tables because of their capability of supporting patients in reclining positions; however, they may also be regarded as chairs because they may be adjusted to support patients in seated positions. For consistency, the term "table" will be used throughout this specification, it being understood that such term is not intended to exclude structures also capable of functioning as chairs.

Such a table must not only be adjustable into a wide variety of elevations and angular positions but must also provide a firm and stable support for a patient during examination and/or minor surgery. For these and other reasons the tops of such tables tend to be heavy. To such weight may be added the weight of a patient supported by the top and, at least in some cases, the downward force exerted by the power drive during a lowering operation. Should the limb of a doctor, nurse, or assistant become trapped beneath the top as it descends under power, or should the descending top engage a table, stand, or surface supporting medical fluids, instrumentation, or other types of medical equipment and supplies, a dangerous condition might readily develop. The problems and dangers tend to be increased by the frequent need to have related medical equipment close at hand, the common occurrence of two or more medical practioners or workers in close proximity to the table, some of whom may be seated at the time the position of the table is changed, the multiplicity of positions and adjustments of which such tables are capable, and the common provision of a foot control unit, often positioned directly beneath the table, for controlling the power to shift the table into its various positions of adjustment. Accidental operation of such a foot controller might easily cause a conventional power-operated table to descend in a way that could result in injury to the operator or to others, or damage to surrounding equipment.

A main aspect of this invention therefore lies in providing a power-operated multi-position medical table which avoids the dangers and disadvantages described above. Specifically, should the table top engage an object as it descends under power, and should the resistance to downward movement equal or exceed the weight of one of the hinged outer portions of the top and the weight of the patient supported by that portion, the hinged section will be free to pivot upwardly because of the resistance imposed by the obstruction even as the power drive for the hinged section continues to operate, and even if the support column for the entire top is retracting under power. Should the resistance to downward travel be great enough to exceed the weight of the top as a whole, combined with the weight of the patient, then the top in its entirety ceases downward travel and power is automatically interrupted.

The power-operated table (chair) has a pedestal and an articulated top supported by that pedestal, the pedestal consisting essentially of a base and an extendable/retractable column mounted upon that base. The column has a plurality of telescoping sections including an upper section connected to the top and a lower section mounted upon the base.

In a preferred embodiment of the invention, the column contains at least one vertically-elongated threaded shaft which is rotatably supported at its lower end upon the base and which may be selectively driven in one direction or the other about its longitudinal axis by means of a reversible motor. An elongated vertical tube, which is operatively connected to the top and constitutes an extension thereof, receives the threaded shaft and has its lower end resting upon a load-bearing member threadedly carried by the shaft. Power rotation of the shaft results in the load-bearing member, tube, and top traveling upwardly or downwardly depending on the direction of shaft rotation. A sensor is mounted to move vertically with the top (in the disclosed embodiment, the sensor is mounted upon the vertical tube) and cooperates with the load-bearing member to detect separation of the load-bearing member from the tube should descent of the top be obstructed by someone or something during a lowering operation, and to immediately interrupt the power drive system upon detection of such separation.

In the disclosed embodiment, two sets of threaded shafts, tubes, and load-bearing members are provided within the extendable/retractable column. Each load-bearing member takes the form of a nut having a support flange at its lower end and a beveled upper surface for engaging the lever arm of a sensing switch to close or open the power circuit during a lowering operation depending on whether the top is or is not supported by the load-bearing members. Means are provided for preventing rotation of each nut within its tube and for limiting the extent of relative axial movement of the tube and nut. Contact between the switch arm and the nut occurs through a side wall opening in the tube. Ideally, the tube is rectangular (square) in cross section. A liner or sleeve may be disposed within the tube and about the threaded shaft to prevent wobbling, reduce noise, and insure smooth operation during extension and retraction of the top.

The articulated top includes an inner or central section that is mounted upon the upper section of the telescoping column. It also includes at least one outer section that is hingedly connected to the central section along a horizontal hinge line. One such outer section may take the form of a hinged back section; another may constitute a hinged legrest section. Auxiliary power means may be provided for pivoting each hinged outer section between a lowered position and any of a variety of raised positions, the auxiliary power means including a second motor for extending and retracting a second load-bearing member. When the motor is operated to extend the second load-bearing member, that member bears against a stop member carried by the other hinged section to pivot that section into its raised condition; conversely, when the load-bearing member is retracted, the hinged section is permitted to lower under its own weight. Should that section of the top engage an obstacle as it descends, the resistance imposed by the obstacle will block further downward movement of the hinged section even though operation of the auxiliary power means continues.

Other features, objects, and advantages of the invention will become apparent from the drawings and specification.

DRAWINGS

DETAILED DESCRIPTION OF PREFERRED EMBODIMENT

Figure 1:
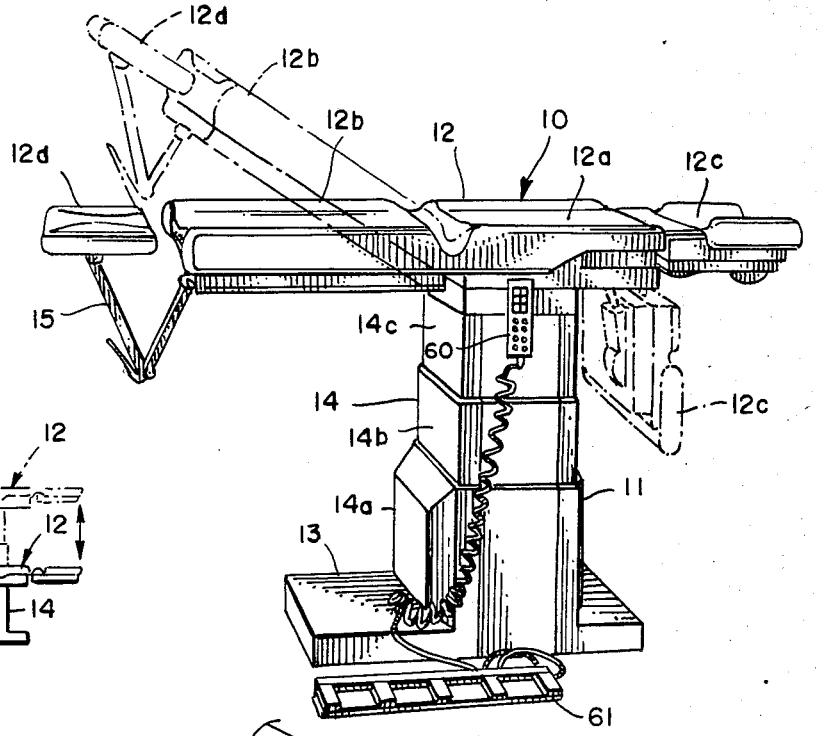
FIG. 1 is a perspective view of a power-operated medical examination table embodying the invention.

FIG. 1 illustrates a medical examination table (chair) 10 having a pedestal 11 and an articulated top 12. The pedestal includes a base 13 and an extendable/retractable column 14 having a plurality of column sections **14*a*, 14*b*, and 14*c*. The lower section 14*a* is joined to base 13 whereas the upper section 14*c* is connected to the seat section or innermost section 12*a*** of the top.

The top also includes outer sections **12*b* and 12*c* that are hingedly connected to the central seat section 12*a* for pivotal movement between the raised and lowered positions depicted in FIG. 1. Section 12*b* serves as a backrest section and, if desired, a headrest 12*d* may be connected to the backrest by linkage 15. Section 12*c*** functions as a leg and foot support section and, in addition to being pivotally mounted for movement between the raised and lowered positions shown in FIG. 1, may also be capable of planar extension and retraction. For further information concerning the leg and foot support assembly and its operation, reference may be had to co-owned copending application Ser. No. 537,341, now U.S. Pat. No. 5,508,387 filed concurrently herewith.

Figure 3:
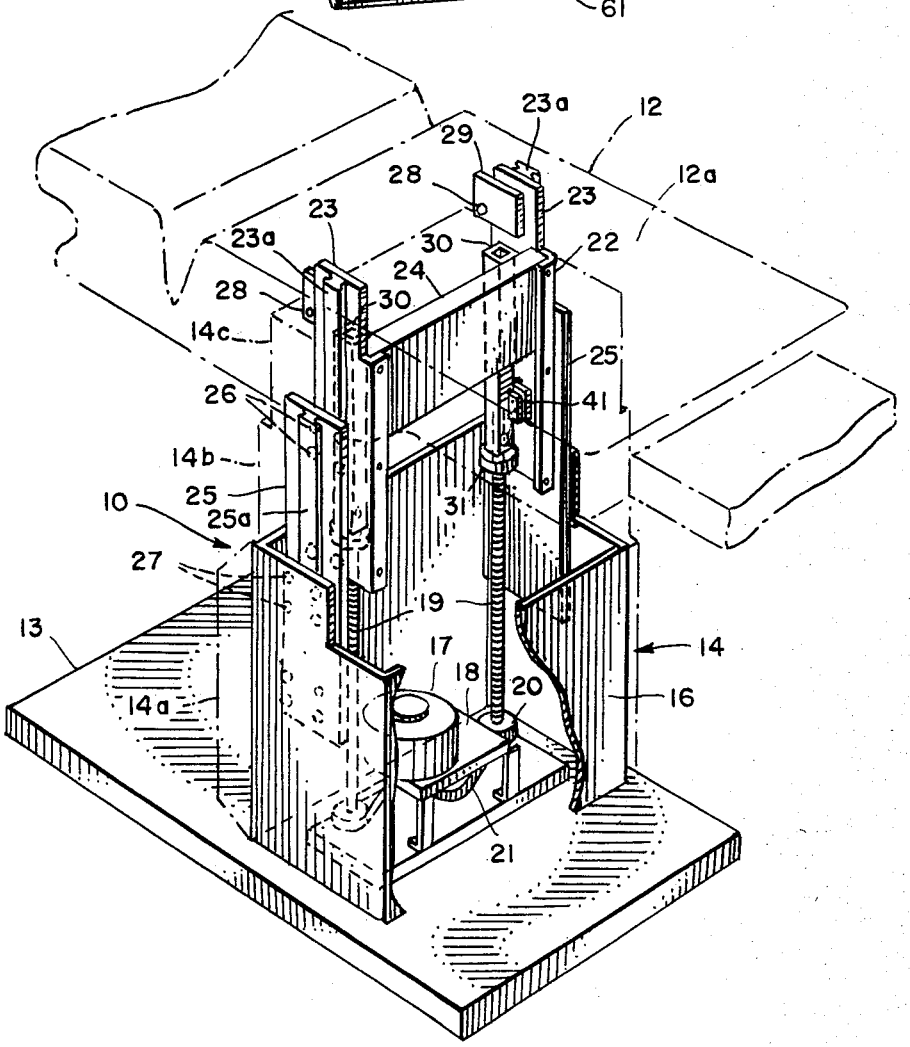
FIG. 3 is a fragmentary perspective view taken partly in section and showing the mechanism for extending and retracting the pedestal column.
Figure 4:
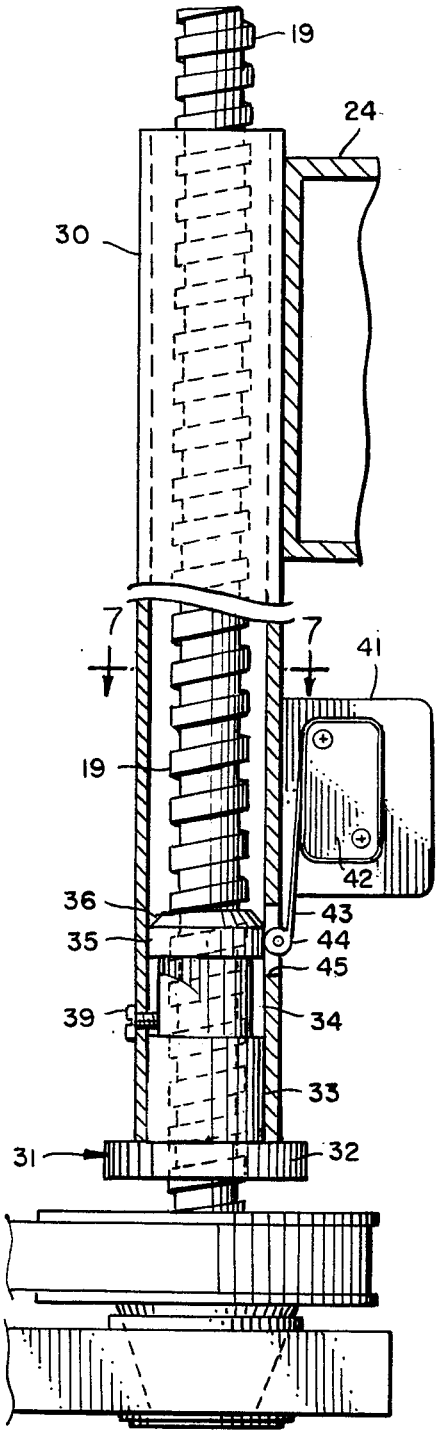
FIG. 4 is an enlarged fragmentary elevational view, taken partly in section, showing the elevating and retracting mechanism of the column.

FIG. 3 illustrates the inner structure of the extendable and retractable column assembly 14. The lower section **14*a* includes an open-topped housing 16 which is secured at its lower end to base 13 and which contains power drive means 17 in the form of a reversible electric motor. The motor is mounted on a platform 18 and a pair of elongated threaded shafts 19 have their lower ends journaled upon the platform. The motor 17 is operatively connected to both of the shafts by suitable pulleys 20 and belts 21** (FIGS. 3 and 4).

The upper section **14*c* includes an inner frame 22 having a pair of spaced vertical guide members 23 and a cross member or brace 24. Intermediate guide members 25 housed within the intermediate section 14*b* of the column assembly operatively interconnect the upper guide members 23 and the lower housing 16. As shown in FIG. 3, the upper guide members 23 are provided with vertical tracks 23*a* and, similarly, the intermediate guide members 25 have vertical tracks 25*a*. Sets of bearings 26 and 27 provided by the intermediate guide members 25 and lower housing 16**, respectively, engage the tracks to guide movement of the sections of the column between the retracted and extended positions shown in FIG. 2.

The frame 22 of the upper column section **14*c* is connected to the seat section 12*a* of top 12. Specifically, pivot pins (not shown) extend through openings 28 in mounting plates 29 at the upper ends of guide members 23 for supporting seat section 12*a*** for limited pivotal movement. For further information concerning such pivotal arrangement and its associated power means, reference may be had to copending co-owned application Serial No. 537,343, filed concurrently herewith.

A pair of elongated vertical tubes 30, preferably of square cross section, have their upper ends secured to the cross member 24 of the frame 22 of upper column section **14*c*. The elongated tubes receive threaded shafts 19 through the open lower ends of those tubes, as shown most clearly in FIG. 4. An internally-threaded load-bearing member or nut 31 threadedly receives shaft 19 and is provided at its lower end with an outwardly projecting flange 32 that normally supports the lower end of tube 30. The load-bearing member or nut also includes a body portion 33 that projects upwardly into the lower end of the tube 30, a reduced intermediate portion 34, and a head portion 35 having an upwardly and inwardly beveled surface 36**.

Figure 6:
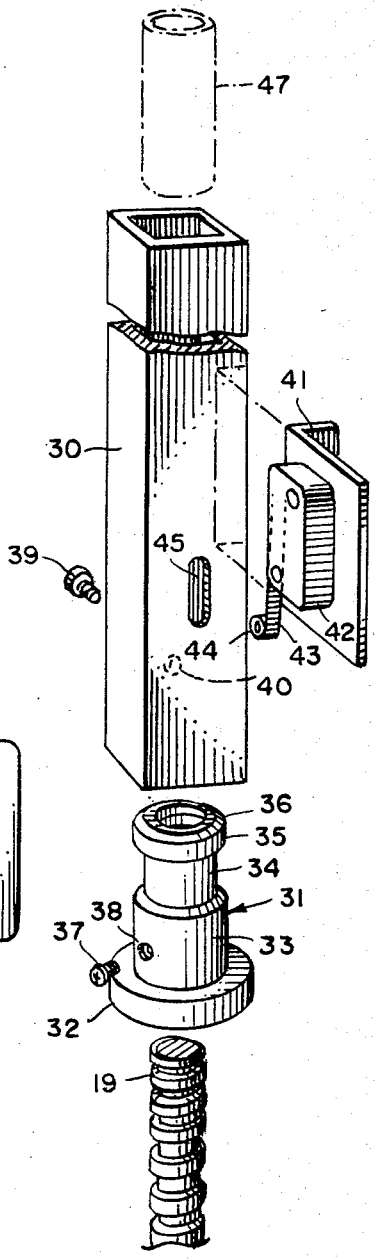
FIG. 6 is an exploded perspective view of the mechanism for extending and retracting the pedestal column.
Figure 7:
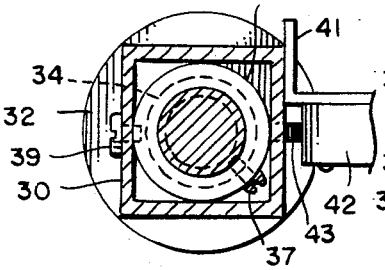
FIG. 7 is an enlarged sectional view taken along line 7—7 of FIG. 4.

Suitable means are provided for preventing rotation of the load-bearing member or nut 31 within the lower end of tube 30. Such a result may be achieved, for example, by forming body portion 33 with a square external configuration (when viewed in cross section) dimensioned to be accommodated within the square cross sectional interior of tube 30. In the embodiment illustrated, a similar result is accomplished by providing the nut with cylindrical outer surfaces and by threading a screw 37 into side opening 38 of the nut so that the head of the screw will be received internally within a corner portion of the square tube and will thereby prevent or limit rotation of the nut within the tube without restraining longitudinal sliding movement between the parts (FIGS. 6 and 7). The extent of such longitudinal sliding movement may in turn be limited by a second screw 39 extending inwardly through threaded opening 40 in the wall of the tube 30, the inner end of the screw being received in the annular space between the head and body portions 35 and 33 of nut 31.

A bracket 41 is rigidly secured to tube 30 adjacent the lower end thereof and supports sensing means in the form of microswitch 42. The microswitch has a lever arm or actuating arm 43 with a free lower end 44 that projects through a side opening 45 in the lower end portion of tube 30 and normally engages the surface of head portion 35 of the load-bearing member to maintain the switch in a closed or circuit-completing condition. However, if the load-bearing member should travel downwardly with respect to the tube for a limited distance (preferably about 0.2 to 0.5 inches), the free end of the switch arm 43 will ride off of the side surface of head portion 35 and the spring-loaded arm or lever of the switch will shift into an opened or circuit-interrupting condition.

Figure 8:
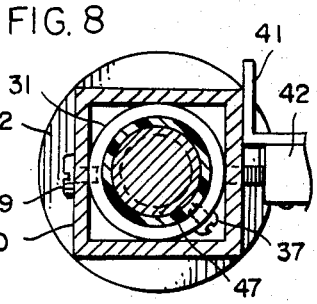
FIG. 8 is a sectional view similar to FIG. 7 but showing an additional sleeve insert.

As shown in broken lines in FIG. 6 and in solid lines in FIG. 8, the elevating and retracting mechanism may also include a bearing sleeve 47 that extends through tube 30 and about threaded shaft 19. The bearing sleeve may be advantageously formed of a polymeric material such as nylon or polypropylene and functions to limit lateral movement of the upper end of shaft 19 within outer tube 30.

While a single drive assembly has been described in detail, such assembly consisting essentially of threaded shaft 19, tube 30, load-bearing member 34, and switch 42, it I believed apparent from FIG. 3 that two such assemblies are preferred to insure smooth operation in extending and retracting the telescoping column 14. It should also be understood, however, that if smoothness of operation can be assured by some other means, extension and retraction of the column might conceivably be achieved by a single drive assembly. Furthermore, while the load-bearing members 34 of this embodiment are raised and lowered by motor-driven threaded shafts, such load-bearing members might instead be raised and lowered by one or more fluid cylinders through which a fluid (liquid or gas) is circulated by suitable power-driven pumping means.

Figure 9:
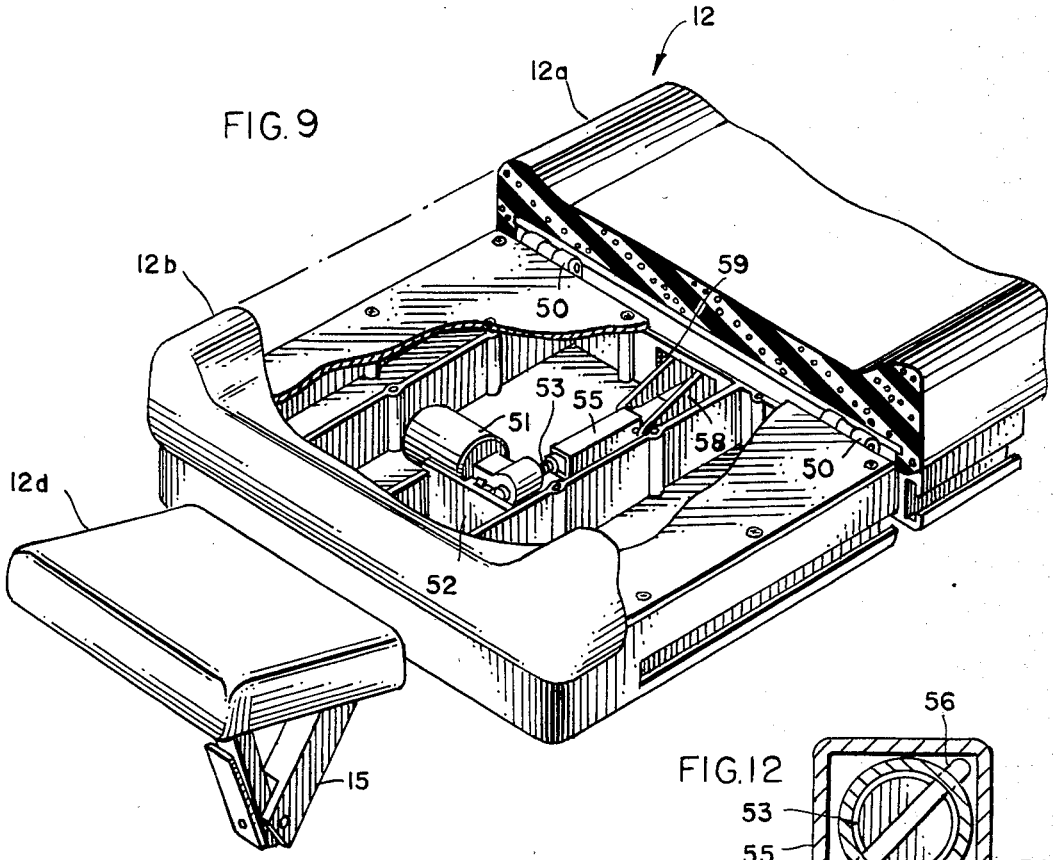
FIG. 9 is a perspective view showing a second mechanism for pivoting an outer section (back section) of the articulated top between raised and lowered positions.
Figure 12:
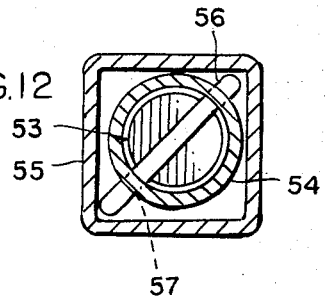
FIG. 12 is an enlarged sectional view taken along line 12—12 of FIG. 10.

FIG. 9 shows an outer section of the top, in this case back section **12*b*, and its hinged connection to the inner or seat section 12*a*. Hinges 50 join the two sections so that the back section may be raised and lowered as indicated in broken and solid lines in FIG. 1. The power means for shifting the back section between its raised and lowered positions takes the form of a second or auxiliary motor 51 pivotally mounted upon bracket 52 within back section 12*b*, the motor being operatively connected to a second threaded shaft 53 which may be selectively rotated in one direction or the other by the reversible motor 51. A threaded and elongated inner tube 54 receives the shaft, the inner tube being in turn slidably received within an elongated outer tube 55. Means are provided to prevent rotation of the inner load-bearing tube 54 within outer tube 55; in the illustration given, the outer tube is of square cross section and such means takes the form of a diagonal pin 56 that extends through diametric openings 57 near the end of tube 54 beyond threaded shaft 53**.

Figure 10:
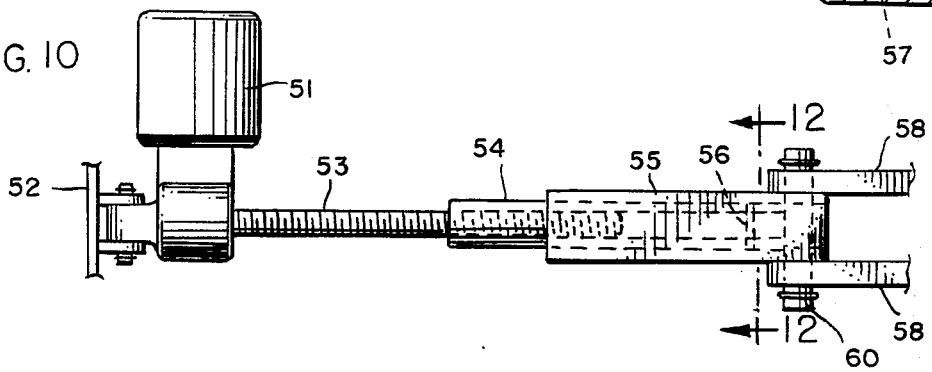
FIG. 10 is a top plan view of the elevating/retracting mechanism of FIG. 9.

The outer tube is pivotally connected at its distal end to seat section **12*a*. A pair of arm extensions 58 of the seat section project into back section 12*b* through opening 59 (FIG. 9) and a pivot pin 60 joins the arm extensions to the outer tube 55 as shown most clearly in FIGS. 10 and 11. FIG. 10 also reveals that under normal operating conditions the distal end of inner tube 54 engages pivot pin 60 and, therefore, the pivot pin functions as stop means to limit the extent of inward sliding movement of tube 54 within tube 55**.

A drive mechanism of the type illustrated in FIGS. 9–12 is also used for raising and lowering footrest section **12*c*, the main difference being that when the footrest section is in its lowered position it extends downwardly at essentially right angles to seat section 12*a*, whereas the back section when fully lowered is generally coplanar with seat section 12*a* (FIG. 1). Since otherwise the operating mechanisms are essentially the same, a detailed description of the structure and operation of the operating mechanism for the footrest section 12*c*** is believed unnecessary herein.

Figure 11:
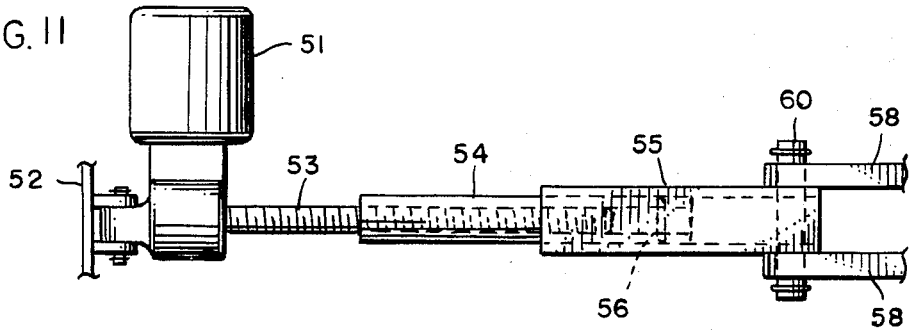
FIG. 11 is similar to FIG. 10 but illustrates the relationship of parts should an obstruction block downward pivoting movement of the back section.

In normal operation, when an outer section of top 12, such as back section **12*b*, is to be pivoted into lowered position, the driving means 51 is actuated (either by pressing the appropriate button of hand control unit 60, or by pivoting a lever of foot control unit 61, as shown in FIG. 1) to rotate threaded shaft 53 and retract threaded inner tube 54. The weight of the pivotally-mounted back section maintains the end of load-bearing inner tube or member 54 in continuous engagement with pivot pin 60 acting as a stop member. However, should the descending back section 12*b* engage an obstacle, continued operation of the motor 51 will simply cause the free end of the inner tube 54 to retract away from pivot pin 60, as illustrated in FIG. 11**, the assumption being that the obstacle imposes sufficient resistance to prevent downward pivoting of the back section under the influence of gravity. When the obstacle is removed, the back section will then swing into its lowered position by the force of gravity.

Figure 2:
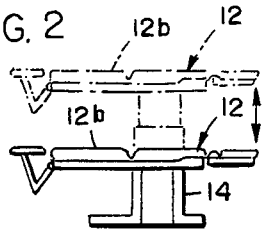
FIG. 2 is a reduced side view of the table showing the range of movement between fully raised and lowered positions.
Figure 5:
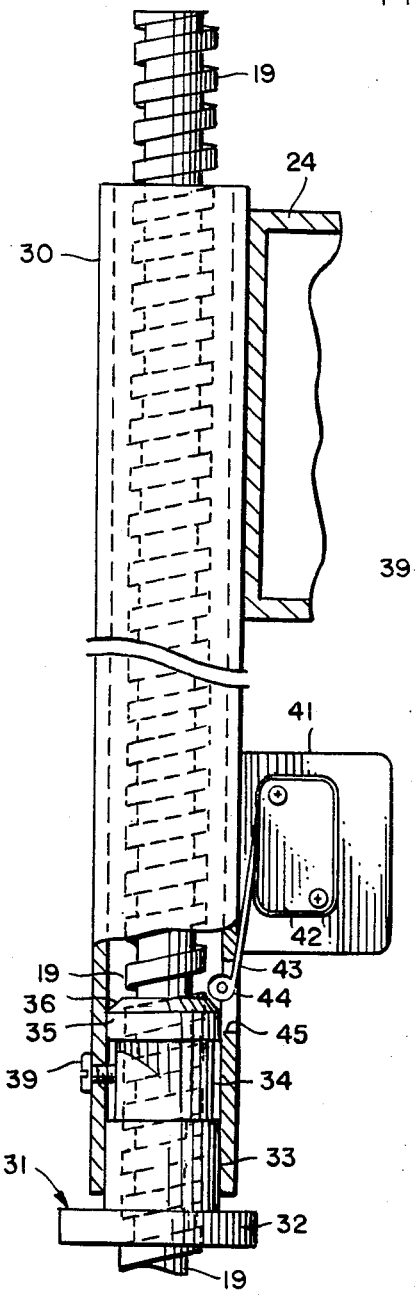
FIG. 5 is an elevational view similar to FIG. 4 but showing the parts in the positions they would assume should the descending top engage a major obstacle.

A similar action will take place, at least initially, if the back section **12*b* engages an obstacle as the entire top 12 is being lowered from a raised position towards a lowered position (as shown in FIG. 2) because of retraction of support column 14 through operation of reversible motor 17. Upon engagement with such an obstacle, the back section is free to pivot upwardly into the broken-line position of FIG. 1 if the resistance imposed by the obstacle is great enough to overcome the gravitational forces acting on the pivotally-supported backrest (including attachments and any additional loading such as the partial weight of a patient). However, should the top continue its descent to the point where the downward forces exerted on the obstruction exceed the weight of the entire top 12 (and the weight of any accessories and patient supported thereby), continued operation of drive motor 17 will cause the load-bearing members or nuts 31 within each of the square tubes 30 to travel downwardly a slight distance, allowing switch arms 43 to swing into their circuit-breaking positions (FIG. 5). Therefore, under conditions where serious injury or damage might otherwise be caused by a limb or other object entrapped beneath any section of top 12 as the top descends, power is quickly interrupted. Subsequent removal of the obstruction will allow the seat section 12*a* to descend without power, but only to the slight extent indicated by the spacing between flange 32 and the bottom of tube 30 in FIG. 5**. Consequently, removal of the obstruction will not result in the entire top dropping freely downwardly a substantial distance into a fully lowered position, since such free fall itself might cause injury to an operator or patient, or damage to the table or other equipment.

While in the foregoing an embodiment of the invention has been disclosed in considerable detail for purposes of illustration, it will be understood by those skilled in the art that many of these details may be varied without departing from the spirit and scope of the invention.

I claim:

1. A power-operated medical examination table having a base, an extensible/retractable column mounted upon said base, a top supported by said column, and means for extending and retracting said column to raise and lower said top; said means including a load-bearing member disposed beneath said top and normally supporting the same; power drive means for selectively raising and lowering said load-bearing member; said load-bearing member being separable from said top when said power drive means is operated to lower said load-bearing member at the same time that an obstructive force prevents lowering of said top; and sensing means for sensing such separation of said load-bearing means from said top and for interrupting operation of said power means; said top including an inner section mounted upon said column and at least one outer section hingedly connected to said inner section along a horizontal hinge line; second power means for pivoting said outer section between lowered and raised positions; said second power means including a second load-bearing member; second power drive means provided on one of said hinged sections for urging said load-bearing member towards and away from said one of said hinged sections; stop means provided by the other of said hinged sections normally engaging and supporting said second load-bearing member, whereby movement of said second load-bearing member by said second power means causes pivotal movement of said outer section relative to said inner section; said stop means and said second load-bearing member being separable from each other when downward pivotal movement of said outer section is restrained by an obstruction.

2. A power-operated medical examination table having a base, an extensible/retractable column mounted upon said base, and a top supported by said column; said column having a plurality of telescoping sections including an upper section connected to said top and a lower section mounted upon said base; means for extending and retracting the sections of said column to raise and lower said top; said means comprising at least one vertically elongated threaded shaft rotatably supported at its lower end upon said base; reversible power means for selectively rotating said shaft in one direction or the other about its longitudinal axis; a load-bearing member threadedly carried by said shaft; a tubular member receiving said shaft and having a lower end normally resting on said load-bearing member; said tubular member having its upper end operatively connected to the upper section of said column; whereby, power rotation of said shaft causes said member, tube, and top to travel upwardly or downwardly depending on the selected direction of shaft rotation; and a switch having a movable arm normally in a first-position engaging said load-bearing member to maintain said switch in electrically-closed condition when said tube rests on said load-bearing member; said arm shifting into a second position to open said switch and interrupt operation of said power means when resistance to downward movement of said top causes said lower end of said tube to lift off of said load-bearing member; said top including an inner section mounted upon said column and at least one outer section hingedly connected to said inner section along a horizontal hinge line; second power means for pivoting said outer section between lowered and raised positions; second power means including a second motor, a second threaded shaft operatively connected thereto, and a second load-bearing member threadedly carried by said second shaft; said second load-bearing member comprising an elongated internally-threaded inner tube; an outer tube telescopingly receiving said inner tube; stop means for limiting the extent of insertion of said inner tube within said outer tube; and means for preventing independent relative rotation of said inner and outer tubes; said outer tube being connected to one of said hinged sections of said top and said second power means being operatively connected to the other of said hinged sections.

3. The examination table of claim 2 in which said load-bearing member has a portion received within said tubular member and a flange at its lower end normally supporting said lower end of said tubular member.

4. The examination table of claim 3 in which said load-bearing member includes a head portion disposed within said tubular member; said tubular member being provided with an opening in the wall thereof adjacent said head portion; said lever of said switch normally projecting through said opening and engaging said head portion.

5. The examination table of claim 2 in which said outer tube is pivotally connected to said one of said hinged sections of said top by means of a pivot pin extending transversely therethrough; said pivot pin constituting said stop means for limiting the extent of insertion of said inner tube into said outer tube.

6. The examination table of claim 2 in which said inner tube is generally cylindrical and said outer tube is generally square in cross section; said means for preventing independent relative rotation of said inner and outer tubes comprising a pin extending diametrically through said inner tube and having its ends projecting outwardly beyond said inner tube; said pin extending diagonally within said outer tube.

7. The examination table of claim 2 in which said second motor is disposed within said outer section of said top and is pivotally connected thereto, and said outer tube is pivotally connected to said inner section of said top.

* * * * *